United States Patent [19]

Yonekawa et al.

[11] Patent Number: 4,867,126

[45] Date of Patent: Sep. 19, 1989

[54] SYSTEM FOR SUPPRESSING DISCHARGE OF EVAPORATED FUEL GAS FOR INTERNAL COMBUSTION ENGINE

[75] Inventors: Masao Yonekawa; Mitsunori Takao, both of Kariya, Japan

[73] Assignee: Nippondenso Co., Ltd., Kariya, Japan

[21] Appl. No.: 884,529

[22] Filed: Jul. 11, 1986

[30] Foreign Application Priority Data

Jul. 17, 1985 [JP] Japan ..... 60-157756

[51] Int. Cl.[4] ..... F02M 39/00

[52] U.S. Cl. ..... 123/520; 123/179 L; 123/198 D

[58] Field of Search ..... 123/179 L, 198 D, 516, 123/518, 519, 520, 521, 458

[56] References Cited

U.S. PATENT DOCUMENTS

| | | | |
|---|---|---|---|
| 3,680,318 | 8/1972 | Nakajima | 123/519 |
| 3,703,165 | 11/1972 | Hansen | 123/518 |
| 4,112,898 | 9/1978 | Takimoto | 123/521 |
| 4,212,276 | 7/1980 | Kaneda | 123/519 |
| 4,318,383 | 3/1982 | Iritani | 123/520 |
| 4,326,489 | 4/1982 | Heitert | 123/520 |
| 4,343,281 | 8/1982 | Uozumi | 123/519 |
| 4,467,769 | 8/1984 | Matsumura | 123/520 |
| 4,475,522 | 10/1984 | Oonaka | 123/519 |
| 4,527,532 | 7/1985 | Kasai | 123/520 |
| 4,577,607 | 3/1986 | Nishio | 123/516 |
| 4,630,581 | 12/1986 | Shibata | 123/520 |

FOREIGN PATENT DOCUMENTS

| | | | |
|---|---|---|---|
| 57-52663 | 3/1982 | Japan | 123/518 |
| 0062955 | 4/1982 | Japan | 123/518 |

*Primary Examiner*—Carl Stuart Miller

*Attorney, Agent, or Firm*—Cushman, Darby & Cushman

[57] ABSTRACT

A system for suppressing discharge of evaporated fuel gas is adapted to introduce the evaporated fuel gas generated in a fuel tank of an internal combustion engine into an intake passage, to suppress the discharge of the evaporated fuel gas into the atmosphere. The system comprises an evaporated fuel gas passage allowing the evaporated fuel gas within the fuel tank to be introduced into the intake passage and a controller variably controlling a cross-sectional area of the evaporated gas passage depending upon an operating condition of the engine. The cross-sectional area of the evaporated gas passage is controlled according to an amount of fuel supplied to the engine. In addition, the cross-section area of the evaporated gas passage may be controlled in response to the operating condition of the engine and may be controlled according to a preliminarily set comparative rotational speed in an idling condition of the engine. Alternatively, the cross-sectional area of the evaporated gas passage may be controlled correspondingly to the operating condition of the engine and, in addition thereto, may be controlled to assume either one of a fully open position and a fully closed position in response to the operating condition of the engine.

15 Claims, 8 Drawing Sheets

FIG. 3
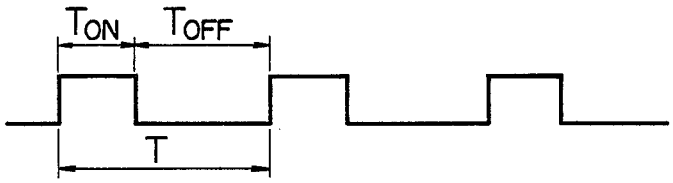
FIG. 4
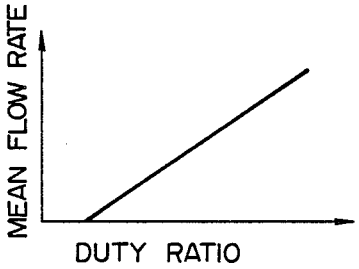
FIG. 6
| Tp \ N | | | | | | | HIGH |
|---|---|---|---|---|---|---|---|
| HIGH | 100% | 100% | 100% | 100% | 100% | 100% | 100% |
| | 90% | 90% | 90% | 95% | 95% | 95% | 100% |
| | 40% | 60% | 70% | 80% | 85% | 90% | 90% |
| | 30% | 30% | 50% | 55% | 60% | 70% | 80% |
| | 10% | 15% | 20% | 30% | 30% | 40% | 50% |
FIG. 7
| Tp \ N | | | | | | | HIGH |
|---|---|---|---|---|---|---|---|
| HIGH | 2.6 | 2.6 | 2.8 | 2.8 | 3.0 | 3.0 | |
| | 2.2 | 2.4 | 2.4 | 2.6 | 2.6 | 2.6 | |
| | 2.0 | 2.2 | 2.4 | 2.4 | 2.4 | 2.4 | |
| | 1.8 | 1.8 | 1.8 | 1.8 | 1.8 | 1.8 | |

SYSTEM FOR SUPPRESSING DISCHARGE OF EVAPORATED FUEL GAS FOR INTERNAL COMBUSTION ENGINE

BACKGROUND OF THE INVENTION

The present invention relates to a system for suppressing discharge of evaporated fuel gas wherein the evaporated fuel gas generated in a fuel tank of an internal combustion engine is introduced into an intake passage to suppress the discharge of the evaporated fuel gas into the atmosphere.

In a vehicle such as a motor vehicle, an adsorption device for evaporated fuel gas such as a charcoal canister has been generally used in preventing pollution of the atmosphere, by which device the evaporated fuel gas generated in a fuel tank or a float chamber of a carburetor is once adsorbed to prevent the evaporated fuel gas from being discharged into the atmosphere The evaporated fuel gas thus adsorbed and held in the charcoal canister is introduced into an intake passage through an evaporated gas passage having ports opening in the intake passage of the engine during the operation thereof.

The above-described ports have been in general so arranged with respect to an intake pipe that one of the ports located upstream of a throttle valve is open when the throttle valve is in the fully closed state while the other port located downstream of the throttle valve is open when the throttle valve is opened to an angle equal to or greater than a predetermined relatively small angle. Thus, the evaporated fuel gas is not introduced into the intake passage when the throttle valve is in its fully closed state, because the upstream port is in communication with the atmosphere, while the evaporated fuel gas is introduced into the intake passage when the throttle valve is opened to an angle equal to or greater than the above-described predetermined angle, because the downstream port is in communication with the negative pressure in the intake pipe.

In Japanese Patent Laid-Open No. 57-52663, for example, there is disclosed a construction wherein a port is located downstream of a throttle valve and a valve is provided in an evaporated gas passage between a canister and the port for opening and closing the evaporated gas passage in such a manner that the valve closes the evaporated gas passage during a low load condition of the engine such as idling thereof thereby intercepting the introduction of the evaporated fuel gas into the intake passage, while the evaporated gas passage is opened when the engine is into a high load condition, thereby introducing the evaporated fuel gas into the intake passage.

In such a prior art device, however, since the control of the evaporated fuel gas is limited only to the manner whether or not it is introduced into the intake passage, the following problems arise:

First, a canister for adsorbing the evaporated fuel gas having a very large capacity is required, since no introduction of the evaporated fuel gas into the intake passage occurs very often under the low load conditions including idling of the engine. In addition, at the beginning of the introduction of the evaporated fuel gas, a very rich evaporated fuel gas is introduced into the intake passage so that the air/fuel ratio of the mixture supplied to the engine is made very high due to the introduction of the evaporated fuel gas, thereby deteriorating the emission of the exhaust gas and the drivability of the engine and causing stall of the engine at the worst. The flow rate of the evaporated fuel gas introduced through the port is uniquely determined by the cross-sectional area of the evaporated gas passage between the canister and the port, thereby requiring the capacity of the canister to be further enlarged. On the other hand, it is necessary to increase the amount of the evaporated fuel gas introduced into the intake passage in order to make the canister compact, thereby giving rise problems contradictory to that of the deterioration of the emission and the drivability.

OBJECT AND SUMMARY OF THE INVENTION

An object of the present invention is to provide a system for suppressing discharge of evaporated fuel gas for an internal combustion engine wherein the cross-sectional area of an evaporated gas passage for introducing evaporated fuel gas into an intake passage of the engine is variably controlled in response to the operating condition of the engine so that the introduction of the evaporated fuel gas into the intake passage is made possible over a wide range from a low load condition including idling of the engine to a high load condition without largely varying the air/fuel ratio of the mixture supplied to the engine, and wherein no canister is required, and further wherein, in case such as canister is required, it can be made to be of a very little capacity.

According to the present invention, there is provided a system for suppressing discharge of evaporated fuel gas for an internal combustion engine to which the fuel is supplied from a fuel tank through an intake passage, the system comprising:

detecting means for detecting an operating condition of the engine to issue a signal;

control circuit means receiving the signal from the detecting means and issuing an actuating signal in response to an amount of fuel supplied to the engine on the basis of the signal from the detecting means;

evaporated gas passage means allowing the evaporated fuel gas within the fuel tank to be introduced into the intake passage; and control means operative in response to the actuating signal from the control circuit means for variably controlling a cross-sectional area of the evaporated gas passage means.

BRIEF DESCRIPTION OF THE DRAWINGS

FIG. 3 is a diagram showing a wave form of a voltage signal applied to a coil of a proportion control valve shown in FIG. 1;

FIG. 4 shows a characteristic of flow rate of the evaporated fuel gas flowing through a passage between inlet and outlet ports of the proportion control valve with respect to a duty ratio ($T_{ON}/T$) of the wave form shown in FIG. 3;

FIG. 6 is a map showing a setting of a basic duty ratio $D_B$;

FIG. 7 is a map showing a setting of a comparative injection time $T_o$;

DETAILED DESCRIPTION

Now embodiments of the present invention will be described below with reference to the accompanying drawings.

Figure 1:
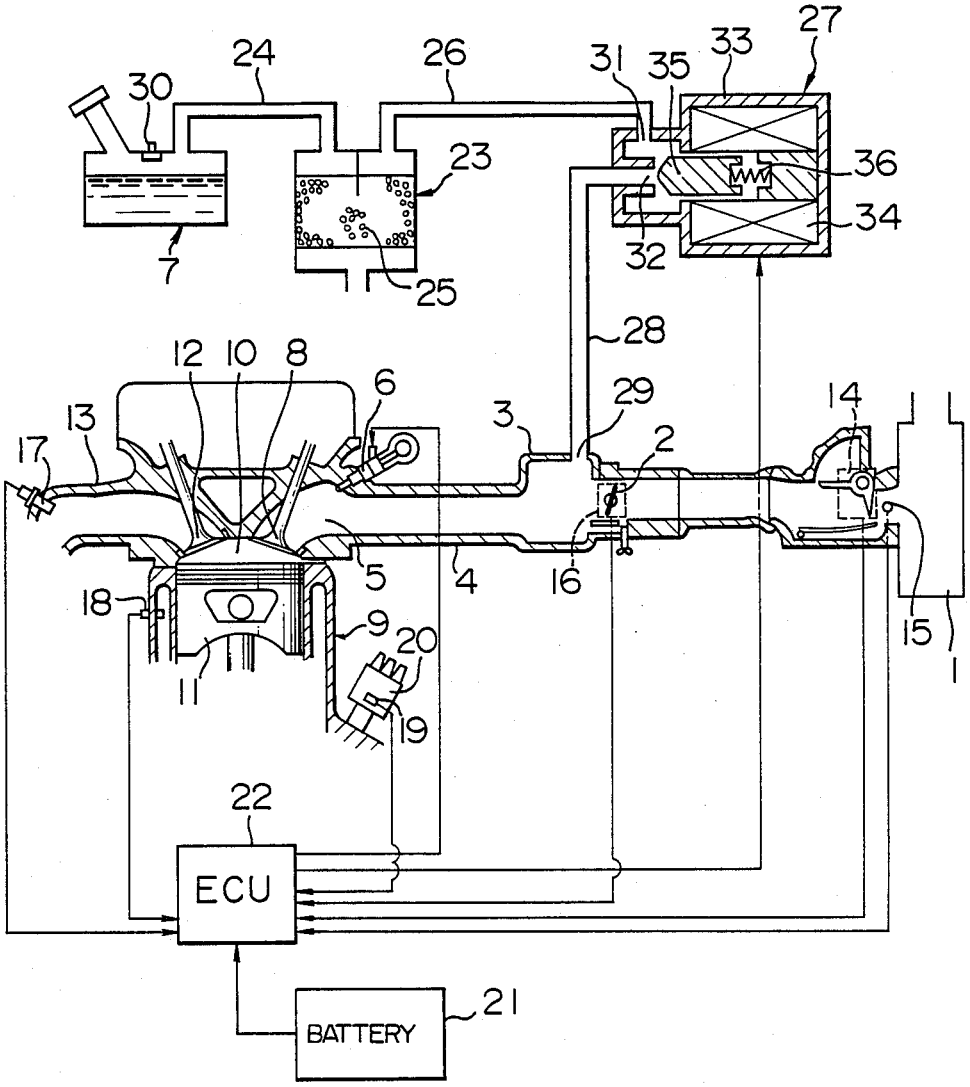
FIG. 1 is a schematic view showing an internal combustion engine into which is incorporated a system for suppressing discharge of evaporated fuel gas according to an embodiment of the present invention, and accessory devices around the engine.

FIG. 1 is a schematic view showing the internal combustion engine in which the system according to an embodiment of the present invention is incorporated and accesory devices around the engine.

In FIG. 1, air is drawn into the engine 9 from an air cleaner 1 and the flow rate of air is controlled by a throttle valve 2 coupled with an acceleration pedal (not shown) which is operated by a driver. The air is introduced into an intake port 5 through a surge tank 3 and an intake pipe 4. The intake pipe 4 is provided with a fuel injection valve 6 to which fuel is supplied from a fuel tank 7 through a fuel piping (not shown). The fuel is injected to the intake port 5 through the fuel injection valve 6. The mixture of fuel and air formed in the intake port 5 is introduced into a combustion chamber 10 of the engine 9 through an intake valve 8. The combustion chamber 10 is defined by a piston 11 and the exhaust gas generated by the combustion of the mixture is discharged to the atmosphere through an exhaust valve 12 and an exhaust pipe 13.

An air flow meter 14 is provided between the air cleaner 1 and the throttle valve 2 and issues an analog signal corresponding to the amount of air drawn into the engine. A temperature sensor 15 for the drawn air is provided in a housing in which the air flow meter 14 is arranged, and the temperature sensor 15 issues an analog signal corresponding to the temperature of the drawing air. A throttle sensor 16 is connected to the rotary shaft of the throttle valve 2 and issues an analog signal corresponding to the degree of opening of the throttle valve 2. The throttle sensor 16 also issues an ON-OFF signal from an idle switch detecting the fully closed condition of the throttle valve 2. An air/fuel ratio sensor 17 is attached to the exhaust pipe 13 and issues an analog signal corresponding to the concentration of the residual oxygen in the exhaust gas. A water temperature sensor 18 is mounted on a water jacket of the engine 9 and issues an analog signal corresponding to the temperature of the cooling water of the engine 9. A crank angle sensor 19 is provided at a position opposed to a ring gear formed on a shaft of a distributor 20 coupled with the crank shaft of the engine 9, and the sensor 19 issues pulse signals successively generated at a predetermined crank angle.

Each of the sensors 14, 15, 16, 17, 18 and 19 and a battery 21 are connected to an electronic control unit (hereinafter referred to as "ECU"), and the signal from each of the sensors and an analog signal corresponding to the voltage of the battery 21 are supplied to the ECU 22.

The fuel tank 7 is provided with a conduit 24 for introducing the evaporated fuel gas within the fuel tank 7 into a charcoal canister 23, and the evaporated fuel gas introduced into the charcoal canister 23 through the conduit 24 is adsorbed in activated charcoal 25 arranged within the charcoal canister 23. A conduit 26 is connected to the charcoal canister 23 and is connected to a conduit 28 through an electromagnetic proportion control valve 27. The conduit 28 is in turn connected to an inlet port 29 opening into the surge tank 3. Thus, the evaporated fuel gas generated within the fuel tank 7 is introduced into the charcoal canister 23 through the conduit 24 and is once adsorbed and held in the activated charcoal therein. The thus adsorbed evaporated fuel gas in the charcoal canister 23 is desorbed and introduced into the surge tank 3 through the conduit 26, the proportion control valve 27, the conduit 28 and the inlet port 29. A relief valve 30 is arranged in the fuel tank 7 and serves to discharge the evaporated fuel gas when the pressure of the evaporated fuel gas in the fuel tank 7 rises due to blockage or clogging of the conduits 24, 26 and 28 which makes it impossible to introduce the evaporated fuel gas into the surge tank 3.

The proportion control valve 27 includes a housing 33 formed with an inlet port 31 connected to the conduit 26 and an outlet port 32 connected to the conduit 28. A coil 34, a movable valve member 35 and a spring 36 are arranged in the housing 33. The proportion control valve 27 variably controls a cross-sectional area of a passage between the inlet port 31 and the outlet port 32 depending upon the position of the movable valve member 35. Specifically, the valve member 35 is normally urged by the spring 36 to close the passage between the inlet port 31 and the outlet port 32. However, when the coil 34 is energized to actuate the valve member 35, the passage between the inlet port 31 and the outlet port 32 is opened, and, the opening degree of the passage continuously varies depending upon the intensity of the exciting electric current supplied to the coil 34 thereby permitting the flow rate of the evaporated fuel gas flowing from the inlet port 31 to the outlet port 32 to be controlled continuously. In this case, the exciting current supplied to the coil 34 is controlled by controlling the voltage applied to the coil 34 on the basis of a duty ratio $T_{ON}/T$ (a ratio of ON time period with respect to a predetermined cycle time T), i.e., a so-called pulse width modulation PWM as shown in FIG. 3. Thus, by varying the duty ratio, a mean flow rate of the evaporated fuel gas flowing from the inlet port 31 to the outlet port 32 varies as shown in FIG. 4. The proportion control valve 27 is driven by the ECU, similarly to the fuel injection valve 6.

Figure 2:
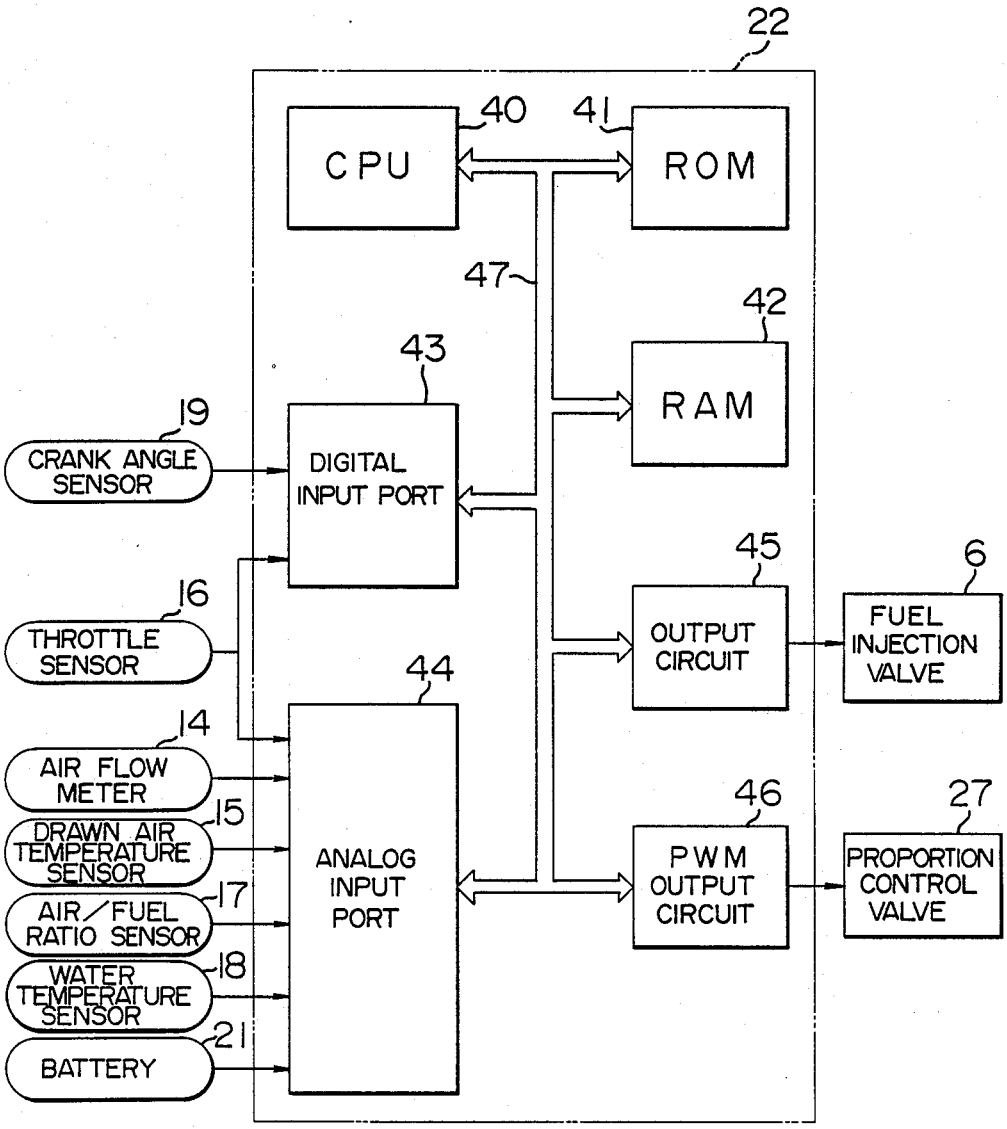
FIG. 2 is a block diagram showing the detail of ECU shown in FIG. 1.

Now, the construction of the ECU 22 will be described below referring to FIG. 2. The ECU 22 comprises a central processing unit (CPU) 40 for carrying out the operation relating to the fuel injection time period, the introduction of the evaporated fuel gas and the like according to a predetermined program, a read only memory (ROM) 41 preliminarily storing therein the program, data and the like, a random access memory (RAM) 2 temporarily storing the data and the like, and a digital input port 42 to which the pulse signals from the crank angle sensor 19 and the ON-OFF signal from the idle switch in the throttle sensor 16 are supplied. The analog input port 44 receives the analog signals from the air flow meter 14, the temperature sensor 15 for the drawn air, the throttle sensor 16, the air/fuel ratio sensor 17, the water temperature sensor 18, and the battery 21 and has an A/D converting function for converting these analog signals to digital signals. An output circuit 45 supplies an actuating signal to the fuel injection valve 6. A PWM output circuit 46 converts the voltage applied to the coil 34 of the proportion control valve 27 into pulse voltage signals of a predetermined duty ratio and issues the signals. The above-described circuits are connected to each other by a data bus 47.

In the ECU 22 constructed as described above, the signals from the sensors are processed in the input ports 43 and 44 and are stored in RAM 42. The operations of the duty ratio and the like determining the fuel injection time duration and the introduced amount of evaporated fuel gas are carried out successively at each predetermined timing in the CPU 40 according to the program stored in the ROM 41 by using the various data stored in the RAM 42, and the results of the operations are stored in the RAM 42. The operation results thus obtained by the CPU 40 and stored in the RAM 42 are converted into output signals corresponding to the operation results by the output circuit 45 and the PWM output circuit 46 in synchronism with the rotation of the engine 9 or at each predetermined time interval, and the output signals are supplied to the fuel injection valve 6 and the proportion control valve 27.

The operation for obtaining the fuel injection time is carried out in the following manner. First, the amount of air drawn into the engine per one revolution thereof Q/N is obtained from the amount Q of air drawn into the engine which is obtained by the analog signal from the air flow meter 14 and stored in the RAM 42 and the rotational speed N of the engine which is obtained by the pulse signals from the crank angle sensor 19 and stored in the RAM 42, and a basic injection time $T_p$ is obtained from the Q/N. Next, if a feedback control with respect to the stoichiometric air/fuel ratio is effected, the basic injection time $T_p$ is corrected according to a correction value $K_{A/F}$ with respect to the stoichiometric air/fuel ratio which is obtained by the analog signal from the air/fuel ratio sensor 17 and stored in the RAM 42. Further, the basic injection time $T_p$ is corrected according to correction values $K_{THW}$ and $K_{THA}$ set in accordance with the temperature of the cooling water of the engine and the temperature of air drawn in the engine respectively obtained by the analog signals from the water temperature sensor 18 and the drawn air temperature sensor 15, to obtain an effective injection time $T_E$. Then, an invalid injection time $T_V$ set in response to the variation of the voltage of the battery is obtained, and this invalid injection time $T_V$ is added to the effective injection time $T_E$ to find out a fuel injection time $T_{INJ}$.

The output circuit 45 includes a counter (not shown) and sets the fuel injection time $T_{INJ}$ obtained by the operation of the CPU 40. The output circuit 45 commences counting down at a predetermined timing in synchronism with the rotation of the engine 9 to cause the electric current to pass through he fuel injection valve 6 until the counting down reaches zero, thereby opening the fuel injection valve 6. Thus, the amount of the fuel to be injected is controlled. It is to be noted that the fuel injection is cut off in the known manner when the throttle valve is closed and the rotational speed is high.

Figure 5:
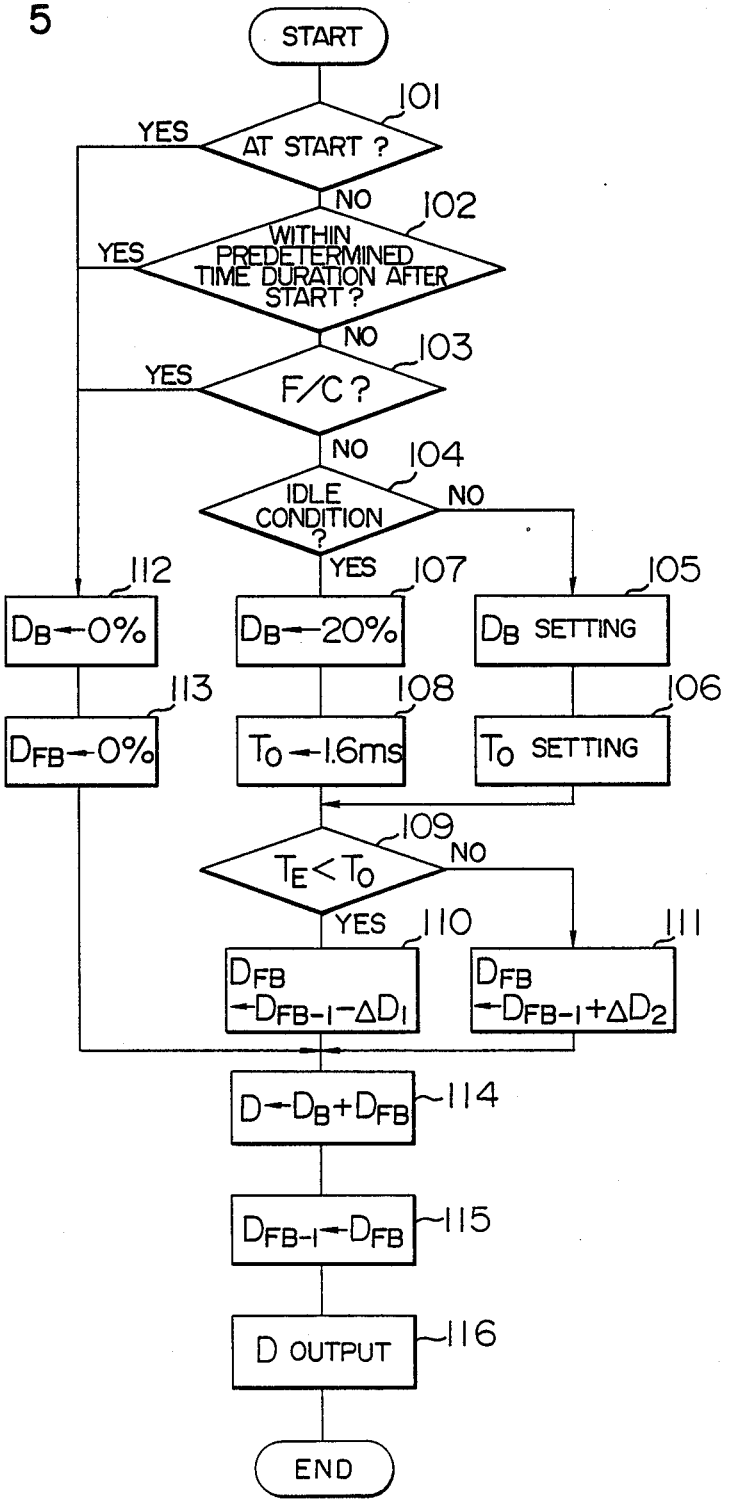
FIG. 5 is a flow chart of a program for obtaining an output duty ratio D which controls the cross-sectional area of the passage between the inlet and outlet ports of the proportion control valve according to the embodiment of the present invention.

The duty ratio of the output to the proportion control valve 27 determining the amount of the evaporated fuel gas to be introduced is obtained by the operation carried out according to the program stored in the ROM 41 shown in FIG. 5. The program is carried out at each predetermined time interval.

First, it is discriminated at the step 101 whether or not the engine is at start. The engine is discriminated as at start, if a starter not shown is ON and the rotational speed N of the engine is equal to or below a predetermined speed. When the discrimination indicates "YES", the program proceeds to a step 112. When the discrimination indicates "NO", the program proceeds to a step 102. In the step 102, it is discriminated whether or not a predetermined time duration lapses after the starting of the engine. When it is discriminated that the predetermined time duration does not yet lapse, the program proceeds to the step 112. When it is discriminated that the predetermined time has already lapsed, the program proceeds to a step 103. The above-described predetermined time duration may be short, and is set to any value within 120 seconds, for example. In the step 103, it is discriminated whether or not the engine is in the fuel cut-off condition. The discrimination as to whether the engine is in the fuel cut-off condition is conducted based on the existance of a fuel cut-off flag which stands when the rotational speed of the engine is equal to or higher than the predetermined rotational speed and the idle switch is in the ON position, for example. When it is discriminated that the engine is under the fuel cut-off condition, the program proceeds to the step 112, while it is discriminated that the engine is not under the fuel cut-off condition, the program proceeds to the step 104. In the step 104, it is discriminated whether or not the engine is under the idling condition. When it is discriminated that the engine is under the idling condition, the program proceeds to the step 107, and when it is discriminated that the engine is not under the idling condition, the program proceeds to a step 105.

In the step 105, a basic duty ratio $D_B$ is set based on the two dimensional map stored and set in the ROM 41 shown in FIG. 6 in accordance with the basic injection time $T_p$ and the rotational speed N of the engine which are presently stored in the RAM 42. The basic duty ratio $D_B$ in the two dimensional map is preliminarily set such that the higher the load, the higher the basic duty ratio $D_B$, since the increase in the introduced amount of evaporated fuel gas, when the amount of air drawn is great such as, for example, under high load condition, has a little influence to the air/fuel ratio of the mixture supplied to the engine 9.

In a step 106, a comparative injection time $T_o$ with respect to the effective injection time $T_E$ is set from the two dimensional map stored and set in the ROM 41 shown in FIG. 7 depending upon the basic injection time $T_p$ and the rotational speed N of the engine which are presently stored in the RAM 42, and the program proceeds to a step 109. The comparative injection time $T_o$ in the two dimensional map is preliminarily set to a value smaller than the effective injection time $T_E$ corresponding to the stoichiometric air/fuel ratio in each of regions distributed on the basis of the basic injection time $T_p$ and the rotational speed N of the engine The comparative injection time $T_o$ may be a fixed value with respect to the drawn air temperature THA and the cooling water temperature THW or may be varied in response to the drawn air temperature THA and the cooling water temperature THW.

When it is judged in the step 104 that the engine is in the idling condition, the basic duty ratio $D_B$ is set to 20% in the step 107, and the comparative injection time $T_o$ is set to 1.6 ms in the step 108. Subsequently, the program proceeds to the step 109.

In the step 109, the comparative injection time $T_o$ is compared with the effective injection time $T_E$ which is calculated during the operation of the above-described fuel injection time $T_{INJ}$ and stored in the RAM 42. In the comparison in the step 109, during a feedback control of the stoichiometric air/fuel ratio the effective injection time $T_E$ is made short if the air/fuel ratio is lowered, i.e., if the mixture is richened and, accordingly, the shortening of the effective injection time $T_E$ than the comparative injection time $T_o$ indicates that the air/fuel ratio is remarkably lowered by virtue of the introduction of the evaporated fuel gas. Thus, if $T_E < T_o$, the feedback duty ratio $D_{FB}$ set with respect to the basic duty ratio $D_B$ in a step 110 is made to a value less than a feedback duty ratio $D_{FB-1}$ set upon the previous principal routine and stored in the RAM 42, by a predetermined value $\Delta D_1$, to provide a feedback duty ratio $D_{FB}$ to be used now. If $T_E \geqq T_o$, the feedback duty ratio $D_{FB}$ to be used now is set in a step 111 to a value greater than the previous feedback duty ratio $D_{FB-1}$ by a predetermined value $\Delta D_2$. The predetermined values $\Delta D_1$ and $\Delta D_2$ in the steps 110 and 111 are set to a value on the order of 1–3%.

When "Yes" is obtained in either one of the steps 101, 102 and 103 and the program proceeds to the step 112, the basic duty ratio $D_B$ is made 0% in the step 112 and the feedback duty ratio $D_{FB}$ is also made 0% in the step 113.

In a step 114, the basic duty ratio $D_B$ and the feedback duty ratio $D_{FB}$ thus obtained are added together so as to provide an output duty ratio D to be used now. In a step 115, the feedback duty ratio $D_{FB}$ to be used now which is obtained in the step 110, 112 or 113 is set in the RAM 42 as a feedback duty ratio $D_{FB-1}$ for use in a subsequent operation. In a step 116, the output duty ratio D is supplied to the PWM output circuit 46.

The PWM output circuit 46 supplies to the proportion control valve 27 a pulse-like output signal having a duty ratio corresponding to the output duty ratio D. The proportion control valve 27 attracts the valve body 35 in accordance with the output signal to variably control the cross-sectional area of the passage between the inlet port 31 and the outlet port 32. Thus, an amount of the vaporated fuel gas corresponding to the thus controlled cross-sectional area of the passage between the ports 31 and 32 is introduced from the inlet port 29 into the surge tank 3.

In the above-described program, the comparative injection time $T_o$ is set to a value corresponding to a value equal to or greater than the lower limit insuring the linearity characteristics of the amount of injection of the fuel injection valve 6. By setting the comparative injection time $T_o$ in the manner as described above, the air/fuel ratio determined by the ratio of the sum of the amount of the injection through the fuel injection valve 6 and the introduced amount of evaporated fuel gas with respect to the amount of the air drawn into the engine is controlled so as to be maintained at the stoichiometric air/fuel ratio during the feedback control to the stoichiometric air/fuel ratio. The amount of the evaporated fuel gas to be introduced into the intake passage is controlled by the feedback duty ratio $D_{FB}$ so as to be reduced when the amount of injection through the fuel injection valve 6 is reduced by the air/fuel ratio feedback control to shorten the effective injection time $T_E$ than the comparative injection time $T_o$. This permits the effective injection time $T_E$ to be controlled so as not to be reduced beyond the comparative injection time $T_o$. Thus, it is possible to avoid the setting of an injection time which might deteriorate the linearity of the amount of injection of the fuel through the fuel injection valve 6.

In the above-described embodiment, it is because of the danger of possible occurrence of impossible starting of the engine or the stall due to the fact that the mixture is over-richened by the introduction of the evaporated fuel gas, that the evaporated fuel gas is not introduced at the start of the engine and during predetermined time duration after the start. The discrimination in the step 102 may be effected based on the rotational speed instead of the time period after the start of the engine.

It is because combustion will not take place solely by the evaporated fuel gas and the gas is discharged to the atmosphere in its non-burnt state, that the evaporated fuel gas is not introduced into the intake passage during the time the supply of the fuel to the engine is cut-off.

In the above-described embodiment, the comparative injection time $T_o$ is set with respect to the effective injection time $T_E$. However, the comparative injection time $T_o$ may be set with respect to the basic injection time $T_p$ or the fuel injection time. $T_{INJ}$.

Therefore, in the above-described embodiment, since the amount of the evaporated fuel gas introduced into the intake passage is varied depending upon the amount of injection of the fuel through the fuel injection valve 6, it is made possible to introduce the evaporated fuel gas in accordance with the conditions of the engine can be introduced into the intake passage, and it is made possible to introduce the evaporated fuel gas into the intake passage without considerably deviating the air/fuel ratio of the mixture. Thus, it is permitted that the evaporated fuel gas is introduced into the intake passage over a wide range of operating condition of the engine including the idle running thereof.

In the above-described embodiment, the evaporated fuel gas is not introduced into the intake passage at the start of the engine, during a predetermined time period after the start and during the time period in which the supply of the fuel to the engine is cut off. These conditions are sufficiently short in the entire range of operation of the engine and, therefore, it will be very few that the concentration of the evaporated fuel gas increases in these conditions. Therefore, it is possible to dispense with the canister 23 from the system. Further, since the evaporation of the fuel is very low in amount when the temperature of the fuel is low, the deviation of the air/fuel ratio is small even though the evaporated fuel gas is introduced into the intake passage at the start of the engine, during the predetermined time period after the start and during the time period in which the supply of the fuel to the engine is cut off. Accordingly, it is also possible to construct the system to allow the introduction of the evaporated fuel gas into intake passage even at the start of the engine, during the predetermined time period after the start and during the time period in which the supply of the fuel to the engine is cut of, when the temperature of the fuel is low.

Figure 8:
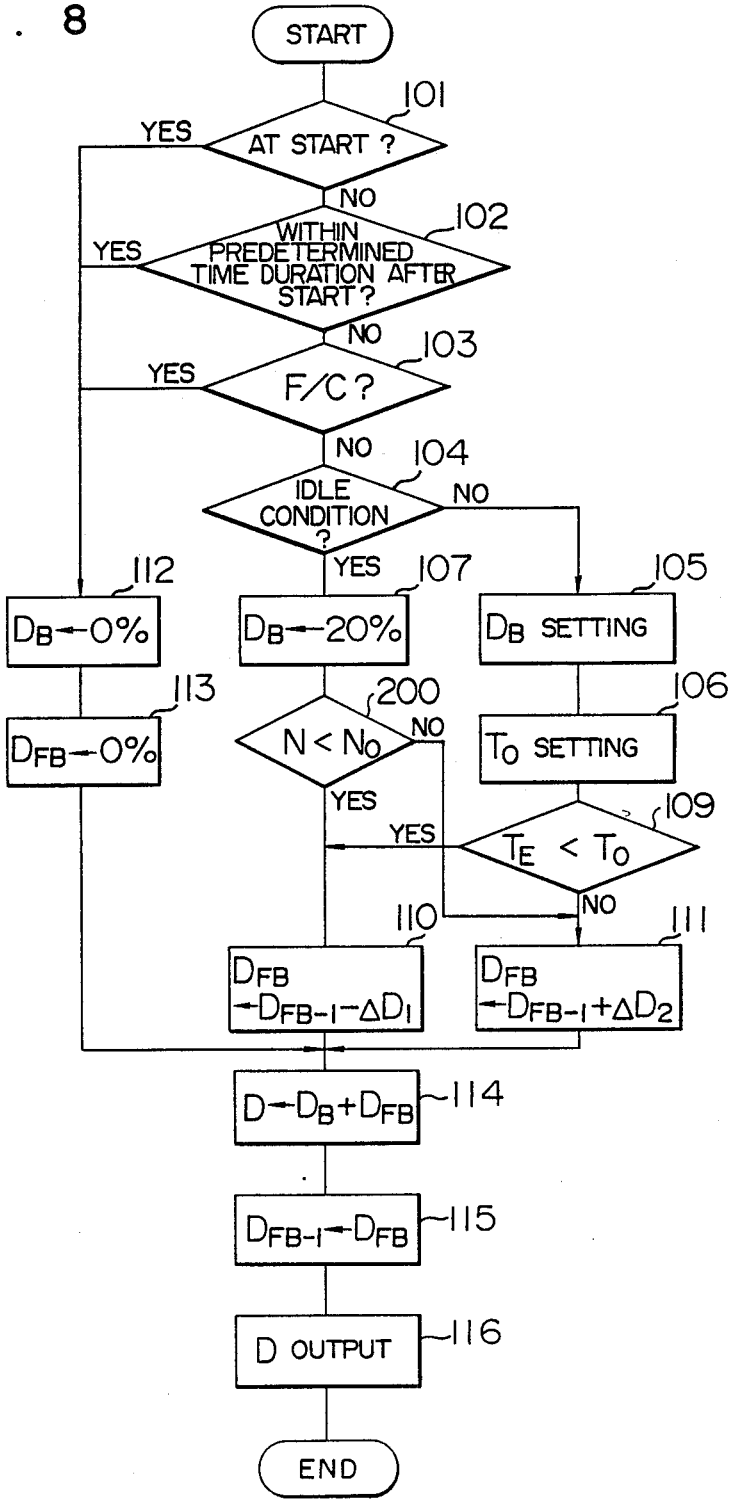
FIGS. 8, 9 and 10 are flow charts respectively showing programs of other embodiments of the present invention.

FIG. 8 shows a program of another embodiment which is basically similar in construction to that shown in FIG. 5, but is slightly different in function in the idle running therefrom. The difference will mainly be described below. In FIG. 8, like reference numerals are used to designate like or similar steps to those shown in FIG. 5, and the description of such similar steps will therefore be omitted.

When the judgment in the step 104 indicates "YES", i.e., that the engine is under the basic duty ratio $D_B$ is set to 20% in the step 107, and the program proceeds to a step 100. In the step 200, the rotational speed N of the engine is compared with the comparative rotational speed $N_o$. If the comparison indicates $N<N_o$, the feedback duty ratio $D_{FB}$ to be used now is obtained by reducing by an amount $\Delta D_1$, the previous feedback duty ratio $D_{FB-1}$, assuming that the air/fuel ratio of the mixture supplied to the engine 9 tends to be too low and the rotational speed N is reduced to a value lower than the comparative rotational speed $N_o$. If the comparison indicates $N \geqq N_o$, the feedback duty ratio $D_{FB}$ to be used now is obtained by increasing the previous feedback duty ratio $D_{FB-1}$ by an amount $\Delta D_2$.

When it is discriminated in the step 104 that the engine is not under the idle running condition, the basic duty ratio $D_B$ is set in the step 105 depending upon the operating condition of the engine and the comparative injection time $T_o$ is set in the step 106 depending upon the operating condition of the engine, similarly to the embodiment shown in FIG. 5. The effective injection time $T_E$ is compared with the comparative injection time $T_o$ in the step 109. The feedback duty ratio $D_{FB}$ to be used now is obtained by reducing the previous feedback duty ratio $D_{FB-1}$ by the amount $\Delta D_1$ (step 110) or by increasing the previous feedback duty ratio $D_{FB-1}$ by the amount $\Delta D_2$ (step 111) depending upon the result of the comparison.

By constructing the system as described above, it can be ensured that the rotational speed of the engine descends during the idling condition due to the tendency of lowering the air/fuel ratio of the mixture by the introduction of the evaporated fuel gas into the intake passage.

The above-described comparative rotational speed $N_o$ is set to be an aimed rotational speed or a rotational speed which is obtained by reducing the aimed rotational speed by several tens to several hundreds revolutions, insofar as the system has feedback control means for controlling the idle running speed to the aimed rotational speed.

Figure 9:
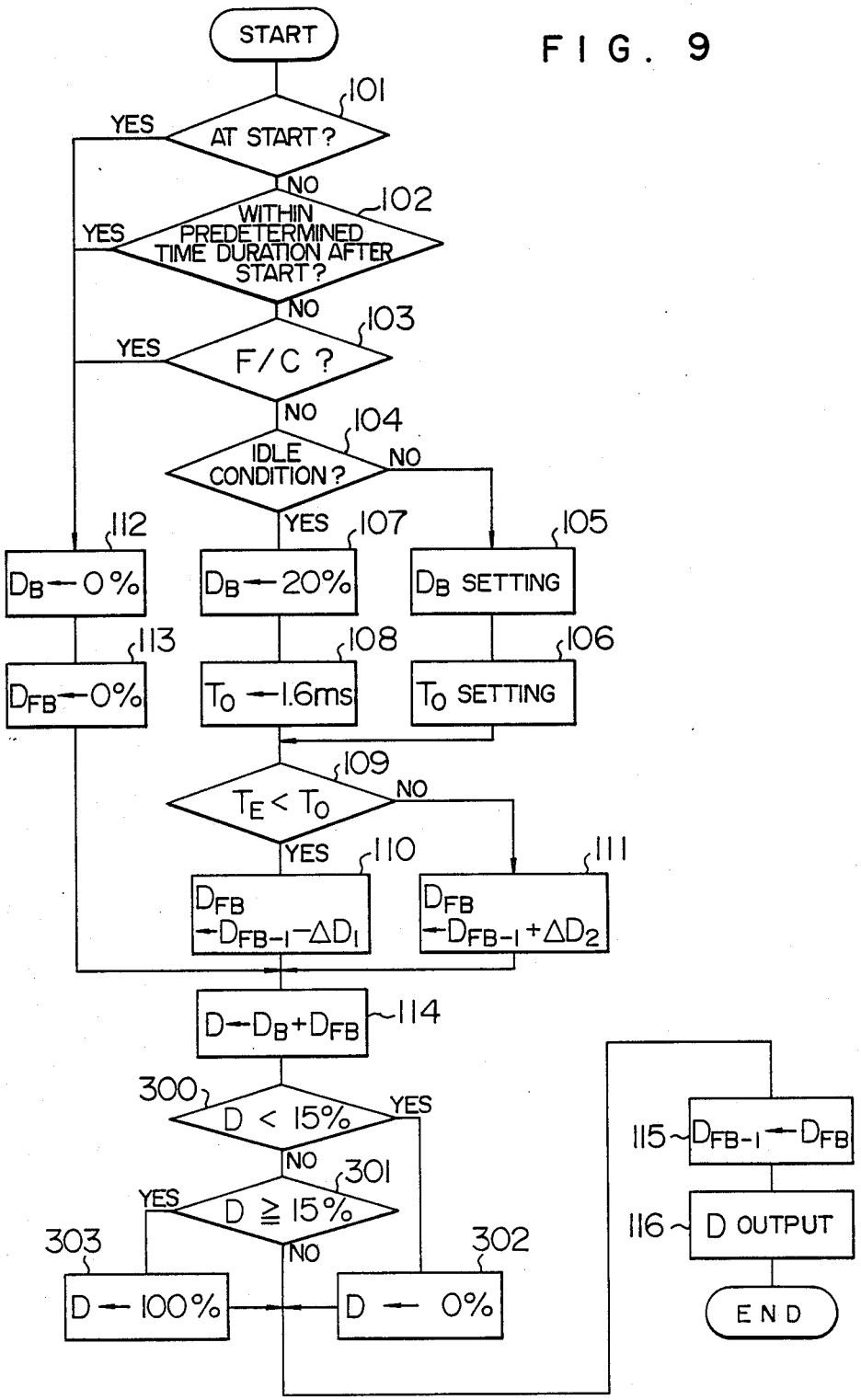
Figure 10:
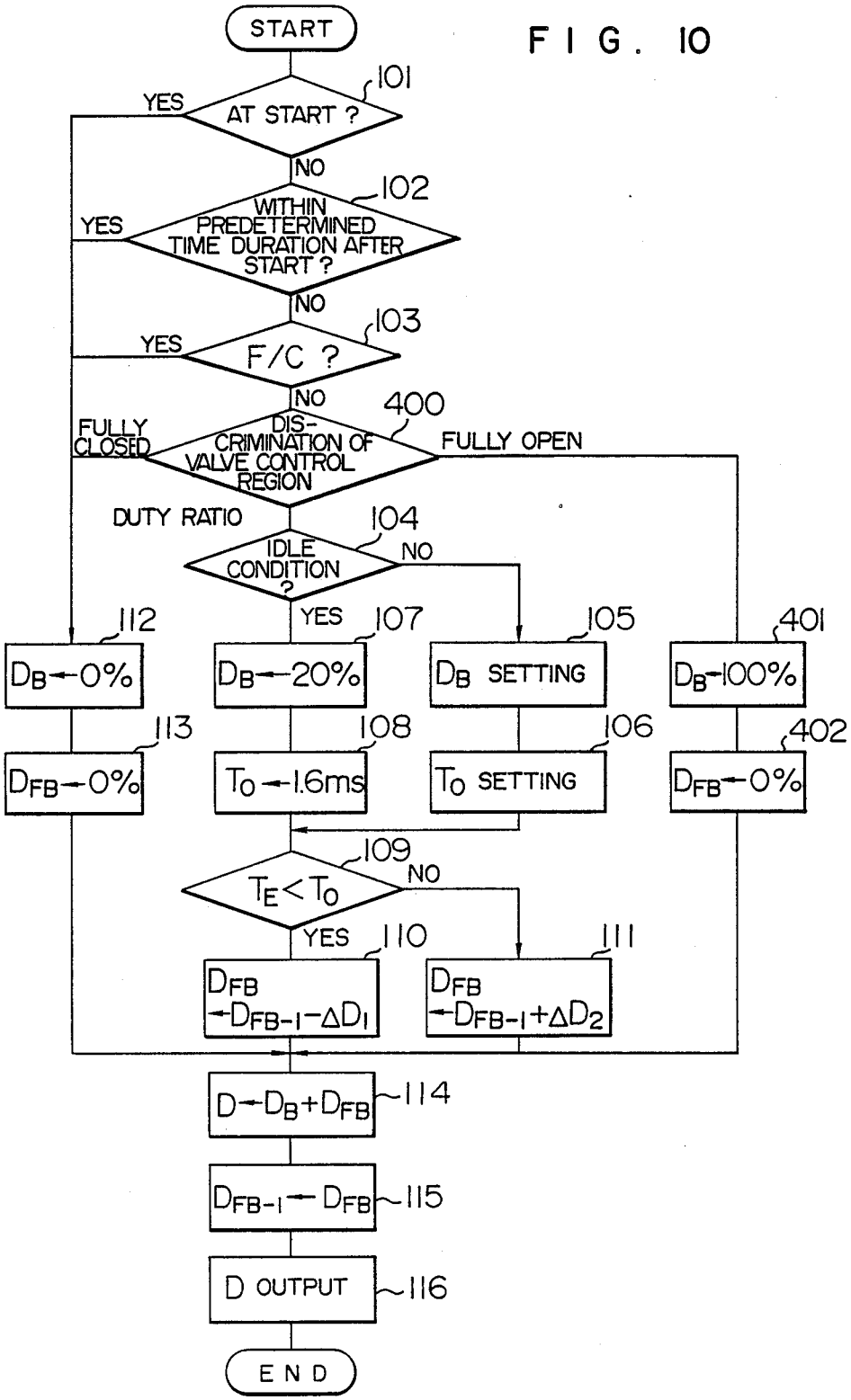

FIGS. 9 and 10 shows programs of further alternative embodiments which are similar in the basic construction to the program shown in FIG. 5, but durability of the valve 27 is taken into consideration. The steps different from the program of FIG. 5 will be described below. In FIGS. 9 and 10, like reference numerals are used to designate like or similar steps to those shown in FIG. 5, and the description of such similar steps will therefore be omitted.

In the program shown in FIG. 9, the output duty ratio D obtained through the steps 101–114 is discriminated in the step 300 as to whether or not $D<15\%$. When $D<15\%$, then the program proceeds to a step 302 and, when $D \geqq 15\%$, then the program proceeds to a step 301 In the step 301, the output duty ratio D is discriminated as to whether or not $D \geqq 95\%$. When $D \geqq 95\%$, the program proceeds to a step 303 and, when $D<95\%$, then the program proceeds to the step 115. In the step 302, the output duty ratio D is set to 0%, and the output duty ratio D is set to 100% in the step 303. Subsequently, the program proceeds to the step 115.

By constructing the system as described above, no output from the PWM output circuit 46 is supplied to the proportion control valve 27 when the output duty ratio is calculated to a value less than 15% so that no current is supplied to the coil 34 thereby causing the valve body 35 to close the output port 32. This is because the flow rate of the evaporated fuel gas through the outlet port 32 is very a little when a pulse-like voltage signal having a duty ratio on the order of 15% is applied to the coil 34 and, therefore, the evaporated fuel gas will hardly be introduced into the surge tank 3. On the other hand, when the duty ratio is calculated to a value equal to or greater than 95%, current is continuously supplied to the proportion control valve 27 by the output from the PWM output circuit 46 so that the passage between the inlet and outlet ports 31 and 32 of the valve body 35 is fully opened. This is because the flow rate of the evaporated fuel gas through the outlet port 32 when a pulse-like voltage signal having the duty ratio on the order of 95% is supplied to the coil 34 is almost equal to the flow rate in the fully opened condition of the proportion control valve 27. Therefore, the durability of the proportion control valve 27 is enhanced by controlling the same by the duty ratio in such a manner that the valve 27 is brought into the fully closed condition and the fully open condition in the regions in which it is unnecessary to control the valve 27.

In a program shown in FIG. 10, a step 400 is added between the steps 103 and 104 of the program shown in FIG. 5. The step 400 discriminates whether the control region of the valve 27 is in the fully closed control region, the fully open control region or the duty ratio control region from the map shown in FIG. 11 and set by the basic injection time $T_p$ and the rotational speed N of the engine. When the judgment indicates the fully closed region, the program proceeds to the step 112. In the step 112, the basic duty ratio $D_B$ is set to 0% and the feedback duty ratio $D_{FB}$ to be used now is set to 0% in the step 113. Subsequently, the program proceeds to the step 114. When the judgment indicates the fully open control region, the program proceeds to the step 401. The basic duty ratio $D_B$ is set to 100% in the step 4001 and the feedback duty ratio $D_{FB}$ to be used now is set to 0% in the step 402. Subsequently, the program proceeds to the step 114. When the judgment indicates the duty ratio control region, the basic duty ratio $D_B$ and the feedback duty ratio $D_{FB}$ to be used now are sought in like manner as in the program shown in FIG. 5 (the steps 104–111), and the program proceeds to the step 114.

By constructing the system as described above, the durability of the proportion control valve 27 can be enhanced in like manner as obtained by the construction of the program of FIG. 9. In addition, when the discrimination results in the fully closed control region or the fully open control region, the steps 104–111 for setting the basic duty ratio $D_B$ and the calculation of the feedback duty ratio $D_{FB}$ to be used now are bypassed and, therefore, the load of operation on the CPU 40 is reduced.

The map for the judgment of the valve control regions (FIG. 11) used in the step 400 is divided into the fully closed control region, the fully open control region and the duty ratio control region. However, it is possible to divide the map into two consisting of the fully closed control region and the duty ratio control region (in this case, the route from the step 400 to the step 114 through the steps 401 and 402 is omitted), or to divide the map into two consisting of the fully open control region and the duty ratio control region (in this case, the route from the step 400 to the step 112 is omitted).

In each of the above-described embodiments, the amount of the drawn air per one revolution of the engine Q/N is used in obtaining the basic injection time $T_p$. However, it is also possible to obtain the basic injection amount $T_p$ from the pressure in the intake pipe by measuring the same.

Figure 11:
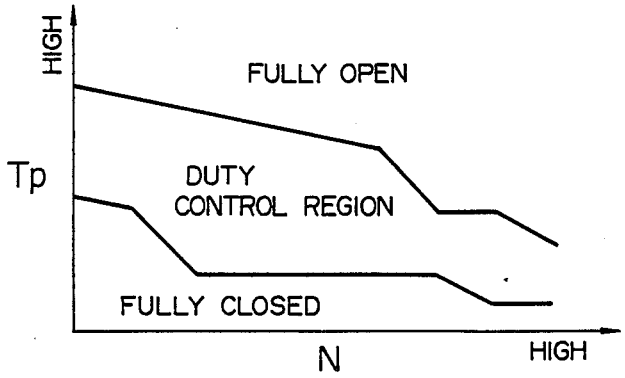
FIG. 11 is a map showing the discrimination of the region of control of the valve used in the step 400 in FIG. 10.
Figure 12:
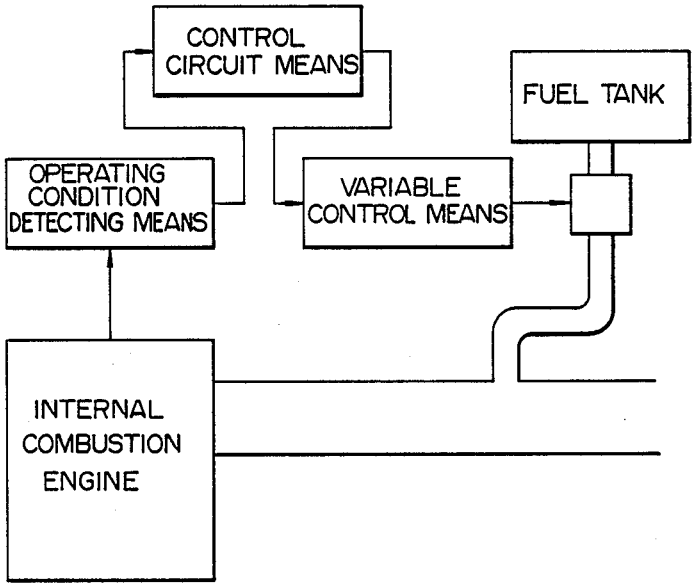
FIG. 12 is a block diagram showing the basic construction of the present invention.

Although the maps shown in FIGS. 6, 7 and 11 used in the above-described embodiments, are set based on the basic injection amount $T_p$ and the rotational speed N of the engine, data relating to the load condition of the engine 9 such as the amount of air drawn into the engine 9, the pressure in the intake pipe, the opening degree of the throttle valve and the like may be substituted for the basic injection amount $T_p$. Further, it is also possible to store calculating equations in the ROM 41 and calculate the required values by using the stored equations without the use of the maps.

As to the valve for controlling the cross-sectional area of the passage between the inlet port 31 and the outlet port 32 in each of the above-described embodiments, the invention is not limited only to the use of the above-described proportion control valve 27, but may utilize a diaphragm type control valve in response to negative pressure, for example. In this case, it is possible to control the cross-sectional area of the passage between the inlet port 31 and the outlet port 32 by controlling the ratio between the negative pressure and the atmospheric pressure. In other words, a valve may be used insofar as it can vary the cross-sectional area of the passage between the inlet port 31 and the outlet port 32.

The above-described embodiments may by applied not only to an internal combustion engine having a fuel injection device of an electronic control type but also to any internal combustion engine having a carburetor.

Further, the above-described embodiments have been described as having feedback control means for the stoichiometric air/fuel ratio. However, it is possible to provide feedback control means for a desired air/fuel ratio instead of the stoichiometric air/fuel ratio.

As described above, according to the present invention there is provided a system for suppressing discharge of evaporated fuel gas characterized by:

operating condition detecting means for detecting an operating condition of an internal combustion engine, an evaporated gas passage for introducing the evaporated fuel gas within a fuel tank into an intake passage of the engine, and variable control means for variably controlling the cross-sectional area of the evaporated gas passage depending upon the operating condition of the engine.

With the system of the invention, it is made possible to carry out the introduction of the evaporated fuel gas depending upon the operating condition of the engine and, therefore, it is made possible to prevent the air/fuel ratio of the mixture supplied to the engine from being largely deviated from the desired value, thereby permitting the introduction of the evaporated fuel gas into the intake passage of the engine over the wide range of operating condition of the engine including the idle running.

Further, since the introduction of the evaporated fuel gas into the intake passage is made possible over the wide range of operation, a device for temporarily adsorbing and retaining the evaporated fuel gas such as the charcoal canister may be dispensed with or may be made a very small capacity even though such is required.

Further, since the feedback duty ratio is so corrected with respect to the basic duty ratio that the amount of the evaporated fuel gas is reduced even though the rich evaporated fuel gas is introduced, the air/fuel ratio of the mixture supplied to the engine can be rapidly returned to a predetermined value.

What is claimed is:

1. A system for suppressing discharge of evaporated fuel gas on an internal combustion engine of the type in which fuel is supplied to the engine from a fuel tank through an intake passage, said system comprising:

first detecting means for detecting a load condition of the engine;

second detecting means for detecting a rotational speed of the engine;

third detecting means for detecting an air/fuel ratio of a mixture of gas introduced into the engine;

evaporated gas passage means for allowing the evaporated fuel gas within said full tank to be introduced into said intake passage;

control valve message, provided at said gas passage means, for proportionally controlling a cross-sectional area of said gas passage means;

first calculating means for calculating an amount of fuel to be supplied to the engine according to said load condition detected by said first detecting means, said rotational speed detected by said second detecting means and said air/fuel ratio detected by said third detecting means so that the air/fuel ratio of said mixture gas is controlled to the stoichiometric air/fuel ratio;

setting means for setting a comparative value to be compared with said amount of fuel according to said load condition detected by said first detecting means and said rotational speed detected by said second detecting means, said comparative value corresponding to a minimum desired value for fuel supplied to the engine;

comparing means for comparing said amount of fuel being supplied to the engine with said comparative value;

second calculating means for calculating a control value according to a result of said comparing means, said second calculating means maintaining said control value above said comparative value despite said third detecting means causing said first calculating means to calculate said amount of fuel less than said comparative value; and control means for controlling said control valve means according to said control value calculated by said second calculating means.

2. A system for suppressing discharge of evaporated fuel gas in an internal combustion engine of the type in which fuel is supplied to the engine from a fuel tank through a fuel injection valve provide in an intake passage, said system comprising:

first detecting means for detecting an operation condition of the engine and issuing a first signal related thereto;

second detecting means for detecting an air/fuel ratio of a mixture of gas introduced into the engine and issuing a second signal related thereto;

control circuit means, receiving said first signal and said second signal, for: (1) issuing an injection signal corresponding to an amount of fuel to be supplied to the engine based on said first signal; and said second signal; (2) setting a comparative value corresponding to a minimum desired value for said injection signal; and (3) issuing an actuating signal which is varied over substantially an entire range of engine operation, said control circuit means adjusting said actuating signal so that said second signal does not cause said control circuit means to lower a value of said injection signal below said comparative value;

evaporated gas passage means for allowing the evaporated fuel gas within said fuel tank to be introduced into said intake passage; and control means provided in said gas passage means and operative in response to said actual signal from said control circuit means for proportionally controlling a cross-sectional area of said evaporated gas passage means so that evaporated gas is introduced into said intake passage over substantially said entire range of engine operation.

3. A system according to claim 2, wherein said control circuit means includes means for discriminating whether or not the amount of control of the cross-sectional area of said evaporated gas passage means exceeds a certain value in a direction to open said evaporated gas passage means, to issue a fully open signal when the amount of control of the cross-sectional area of said evaporated gas passage means exceeds the certain value, said fully open signal causing said control means to control said evaporated gas passage means so as to be fully opened.

4. A system according to claim 2, wherein said control circuit means includes means for discriminating whether or not the amount of control of the cross-sectional area of said evaporated gas passage means exceeds a certain value in a direction to close said evaporated gas passage means, to issue a fully closed signal when the amount of control of the cross-sectional area of said evaporated gas passage means exceeds the certain value, said fully closed signal causing said control means to control said evaporated gas passage means so as to be fully closed.

5. A system according to claim 2, wherein said control circuit means includes means for discriminating whether or not the engine is at a start condition and whether or not a predetermined time duration lapses from the start condition, to issue a fully closed signal when the engine is at the start condition and when the predetermined time duration does not lapse from the start condition, said fully closed signal causing said control means to control said evaporated gas passage means so as to be fully closed.

6. A system according to claim 2, wherein said control circuit means includes means for discriminating whether or not said engine is under a fuel cut-off condition, to issue a fully closed signal when said engine is under the fuel cut-off condition, said fully closed signal causing said control means to control said evaporated gas passage means so as to be fully closed.

7. A system for suppressing discharge of evaporated fuel gas in an internal combustion engine of the type in which fuel is supplied to the engine from a fuel tank through an intake passage, said system comprising:

means for detecting a load condition of the engine and issuing a detection signal related thereto;

means for detecting a rotational speed of said engine and issuing a rotation signal related thereto;

control circuit means receiving said detection signal from said detecting means and issuing an actuating signal continuously as a function of said detection signal from said detecting means, over substantially a whole range of engine operation, said control circuit means receiving said rotation signal and judging whether or not said rotational speed is lowered to a comparative speed and varying said actuating signal to prevent said rotational speed from being lowered to said comparative speed when said load condition is an idle condition;

evaporated gas pressure means allowing the evaporated fuel gas within said fuel tank to be introduced into said intake passage; and control means provided in said gas passage means and operative in response to said actuating signal from said control circuit means for proportionally controlling a cross-sectional area of said evaporated gas passage means so that evaporated gas is introduced into said intake passage over substantially said whole range of engine operation.

8. A system according to claim 7, wherein said control circuit means includes means for discriminating whether or not the amount of control of the cross-sectional area of said evaporated gas passage means exceeds a certain value in a direction to open said evaporated gas passage means, to issue a fully open signal when the amount of control of the cross-sectional area of said evaporated gas passage means exceeds the certain value, said fully open signal causing said control means to control said evaporated gas passage means so as to be fully opened.

9. A system according to claim 7, wherein said control circuit means includes means for discriminating whether or not the amount of control of the cross-sectional area of said evaporated gas passage means exceeds a certain value in a direction to close said evaporated gas passage means, to issue a fully closed signal when the amount of control of the cross-sectional area of said evaporated gas passage means exceeds the certain value, said fully closed signal causing said control means to control said evaporated gas passage means so as to be fully closed.

10. A system according to claim 7, wherein said control circuit means includes means for discriminating whether or not the engine is at a start condition and whether or not a predetermined time duration lapses from the start condition, to issue a fully closed signal when the engine is at the start condition and when the predetermined time duration does not lapse from the start condition, said fully closed signal causing said control means to control said evaporated gas passage means so as to be fully closed.

11. A system according to claim 7, wherein said control circuit means includes means for discriminating whether or not said engine is under a fuel cut-off condition, to issue a fully closed signal when said engine is under the fuel cut-off condition, said fully closed signal causing said control means to control said evaporated gas passage means so as to be fully closed.

12. A system according to claim 2, wherein said actuating signal from said control circuit means is a pulse signal of a variable duty ratio (D);

said control means is controlled in accordance with the variable duty ratio (D) of said actuating signal;

said duty ratio (D) is determined by the sum of a basic duty ratio ($D_B$) and a feed back duty ratio ($D_{FB}$), and wherein said control circuit means includes:

(a) means for detecting a fuel injection time ($T_E$) of said fuel injection valve on the basis of said first signal and said second signal;

(b) means for judging whether or not said engine is in an idle condition;

(c) means for setting as said basic duty ratio ($D_B$), a value predetermined for the operating condition of said engine when said engine is not in the idle condition;

(d) means for setting, as a comparative injection time ($T_o$) to be compared with said injection time ($T_E$), a value predetermined for the operating condition of the engine when said engine is not in the idle condition;

(e) means for comparing said injection time ($T_E$) with said comparative injection time ($T_o$);

(f) means for setting, as said feed back duty ratio ($D_{FB}$), a value equal to a previously set feed back duty ratio ($D_{FB-1}$) minus a first predetermined value ($\Delta D1$) when said injection time ($T_E$) is smaller than said comparative injection time ($T_o$); and (g) means for setting, as said feed back duty ratio ($D_{FB}$), a value equal to the previously set feed back duty ratio ($D_{FB-1}$) plus a second predetermined value ($\Delta D2$) when said injection time ($T_E$) is not smaller than said comparative injection time ($T_o$).

13. A system according to claim 2, wherein said actuating signal from said control circuit means is a pulse signal of a variable duty ratio (D);

said control means is controlled in accordance with the variable duty ratio (D) of said actuating signal;

said duty ratio (D) is determined by the sum of a basic duty ratio ($D_B$) and a feed back duty ratio ($D_{FB}$), and wherein said control circuit means includes:

(a) means for detecting a fuel injection time ($T_E$) of said fuel injection value on the basis of said first signal and said second signal;

(b) means for judging whether or not said engine is in an idle condition;

(c) means for setting, as said basic duty ratio ($D_B$), a predetermined value when said engine is in the idle condition;

(d) means for setting a predetermined time as a comparative injection time ($T_o$) to be compared with said injection time ($T_E$) when said engine is in the idle condition;

(e) means for comparing said injection time ($T_E$) with said comparative injection time ($T_o$);

(f) means for setting, as said feed back duty ratio ($D_{FB}$), a value equal to a previously set feed back duty ratio ($D_{FB-1}$) minus a first predetermined value ($\Delta D1$) when said injection time ($T_E$) is smaller than said comparative injection time ($D_{FB-1}$) plus a second predetermined value ($\Delta D2$) when said injection time ($T_E$) is not smaller than said comparative injection time ($T_o$).

14. A system according to claim 12, wherein said control circuit means further includes:

means for setting, as said basic duty ratio ($D_B$), a predetermined value when said engine is in its idle condition; and means for setting a predetermined time as a comparative injection time ($T_o$) to be compared with said injection time ($T_E$) when said engine is in the idle condition.

15. A system according to claim 7, wherein said actuating signal from said control circuit means is a pulse signal of a variable duty ratio (D);

said control means is controlled in accordance with the variable duty ratio (D) of said actuating signal;

said duty ratio (D) is determined by the sum of a basic duty ratio ($D_B$) and a feed back duty ratio ($D_{FB}$), and wherein said control circuit means includes:

(a) means for judging whether or not said engine is in an idle condition;

(b) means for setting, as said basic duty ratio ($D_B$), a predetermined value when said engine is in the idle condition;

(c) means for setting said comparative speed ($N_o$) to be compared with said rotational speed (N) when said engine is in the idle condition;

(d) means for comparing said rotational speed (N) with said comparative speed ($N_o$);

(e) means for setting, as said feed back duty ratio ($D_{FB}$), a value equal to a previously set feed back duty ratio ($D_{FB-1}$) minus a first predetermined value ($\Delta D1$) when said rotational speed (N) is smaller than said comparative speed ($N_o$); and (f) means for setting, as said feed back duty ratio ($D_{FB}$), a value equal to the previously set feed back duty ratio ($D_{FB-1}$) plus a second predetermined value ($\Delta D2$) when said rotational speed (N) is not smaller than said comparative speed ($N_o$).

* * * * *